US006705298B2

(12) United States Patent
Ramamurthy et al.

(10) Patent No.: US 6,705,298 B2
(45) Date of Patent: Mar. 16, 2004

(54) FUEL PUMP MODULE

(75) Inventors: Dhyana Ramamurthy, Novi, MI (US); Tatsuya Matsumoto, Troy, MI (US)

(73) Assignee: Denso International America, Inc., Southfield, MI (US)

( * ) Notice: Subject to any disclaimer, the term of this patent is extended or adjusted under 35 U.S.C. 154(b) by 59 days.

(21) Appl. No.: 10/151,619

(22) Filed: May 20, 2002

(65) Prior Publication Data

US 2003/0213477 A1 Nov. 20, 2003

(51) Int. Cl.[7] ..... F02M 37/04; F04F 5/00

(52) U.S. Cl. ..... 123/509; 123/514; 417/151

(58) Field of Search ..... 123/509, 514, 123/497, 510–11; 417/151

(56) References Cited

U.S. PATENT DOCUMENTS

| | | | | |
|---|---|---|---|---|
| 3,134,338 | A | | 5/1964 | Dodge |
| 3,729,273 | A | | 4/1973 | Shimrony |
| 3,923,247 | A | | 12/1975 | White |
| 4,144,109 | A | | 3/1979 | Waligorski |
| 4,259,419 | A | | 3/1981 | Uba et al. |
| 4,487,553 | A | | 12/1984 | Nagata |
| 4,595,344 | A | | 6/1986 | Briley |
| 4,830,239 | A | | 5/1989 | Tackles et al. |
| 4,911,134 | A | | 3/1990 | Olsson |
| 5,024,583 | A | | 6/1991 | Sasaki et al. |
| 5,133,324 | A | | 7/1992 | Michiaki |
| 5,196,079 | A | | 3/1993 | Sager |
| 5,275,767 | A | | 1/1994 | Micciche |
| 5,289,810 | A | * | 3/1994 | Bauer et al. ..... 123/510 |
| 5,330,475 | A | | 7/1994 | Woodward et al. |
| 5,411,616 | A | | 5/1995 | Desai et al. |
| 5,452,701 | A | | 9/1995 | Tuckey |
| 5,502,631 | A | | 3/1996 | Adachi |
| 5,560,342 | A | | 10/1996 | Fournier et al. |
| 5,667,366 | A | | 9/1997 | Reef et al. |
| 5,692,479 | A | * | 12/1997 | Ford et al. ..... 123/514 |
| 5,699,773 | A | | 12/1997 | Kleppner et al. |
| 5,769,061 | A | * | 6/1998 | Nagata et al. ..... 123/509 |
| 5,787,865 | A | | 8/1998 | Harris et al. |
| 5,791,317 | A | * | 8/1998 | Eck ..... 123/510 |
| 5,960,775 | A | | 10/1999 | Tuckey |
| 6,210,123 | B1 | | 4/2001 | Wittrisch |
| 6,213,726 | B1 | | 4/2001 | Tuckey |
| 6,269,800 | B1 | | 8/2001 | Fischerkeller et al. |
| 6,293,256 | B1 | * | 9/2001 | Kleppner et al. ..... 123/509 |
| 6,296,454 | B1 | | 10/2001 | Schmid et al. |
| 6,343,589 | B1 | * | 2/2002 | Talaski et al. ..... 123/514 |
| 6,425,378 | B1 | * | 7/2002 | Frank ..... 123/514 |
| 6,474,310 | B2 | * | 11/2002 | Joos et al. ..... 123/497 |
| 6,502,558 | B1 | * | 1/2003 | Brunel ..... 123/509 |

* cited by examiner

*Primary Examiner*—Thomas N. Moulis
(74) *Attorney, Agent, or Firm*—Harness, Dickey & Pierce, PLC

(57) ABSTRACT

A fuel pump module includes a reservoir having a jet pump attached to the outer surface of the reservoir. The jet pump includes a pump body which is ultrasonically welded to the reservoir and a jet nozzle which extends from the pump body towards an inlet to the reservoir. An alignment device or the jet pump engages an alignment device on the reservoir to ensure that the jet nozzle will be in accurate alignment with the inlet of the reservoir.

26 Claims, 3 Drawing Sheets

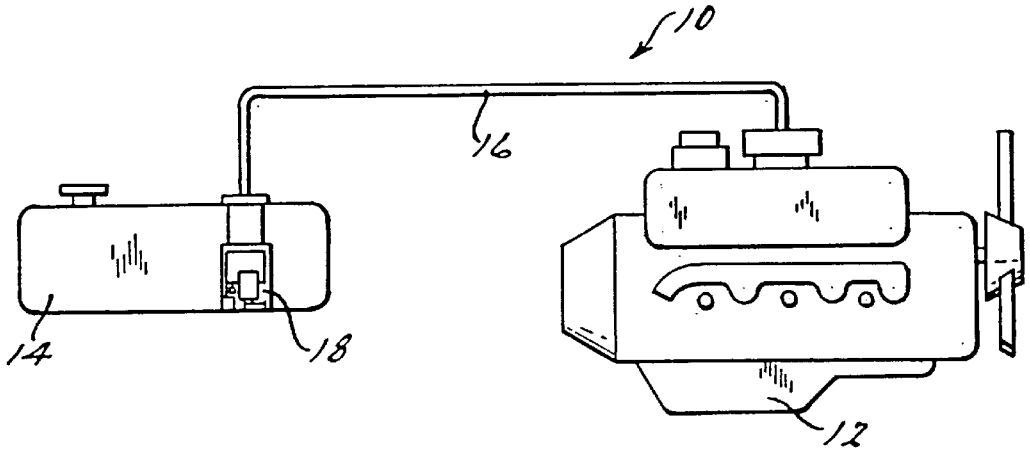
FIG. 1.
FIG. 2.
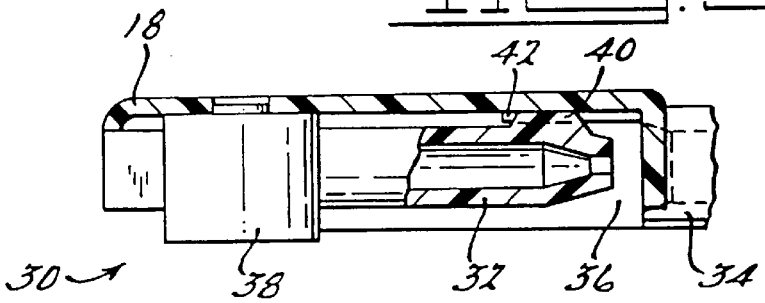
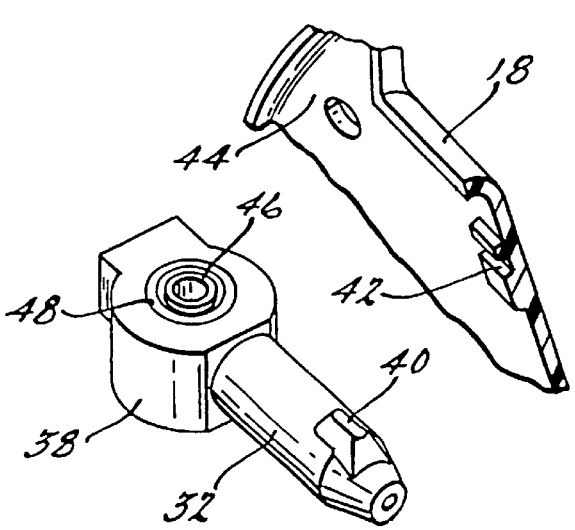
FIG. 4.

FUEL PUMP MODULE

FIELD OF THE INVENTION

The present invention relates to fuel pump modules for use in an automotive fuel system. More particularly, the present invention relates to an improved fuel pump module which improves the alignment between the jet pump nozzle and the throat.

BACKGROUND OF THE INVENTION

In recent years, an increasing number of automobiles have included fuel systems wherein the fuel pump for the system is incorporated within the fuel tank of the automobile. In such systems, the fuel pump is typically located within a canister or reservoir in the fuel tank and the reservoir is overfilled with fuel supplied from a fuel return line which returns an oversupply of fuel from the automobile's engine (a return system) or from the excess fuel from a pressure regulator (returnless system). As the fuel returns from the engine through the return line, it is typically routed through a venturi orifice or jet pump and into an inlet passage leading into the canister or reservoir. The inlet passage is submerged in fuel within the fuel tank and the fuel exiting the venturi or jet pump creates a pressure drop in the area of the inlet passage such that additional fuel from the fuel tank is conveyed into the canister or reservoir along with the fuel jetted from the venturi orifice or jet pump into the inlet passage.

The venturis or jet pumps in use today are generally formed as fixed nozzles wherein the orifice size is optimized for the anticipated use. When the barrel of the jet pump nozzle is extended in length to facilitate the installation of the jet pump to the fuel tank and/or optimize the position of the throat opening, the increase in length will exaggerate the angular deviation located at the outlet of the nozzle. This angular deviation is caused by the designed dimensional tolerances, the manufacturing tolerances and the manufacturing procedures. Any misalignment of the jet pump nozzle and the throat will adversely affect the performance of the pump by potentially causing a severe loss in suction performance of the jet pump, ultimately leading to poor driveability of the vehicle.

The continued development for the jet pumps for the fuel systems has been directed to jet pump designs and jet pump manufacturing procedures which reduce and/or eliminate misalignment between the jet pump nozzle and the throat, especially when an extended length jet pump nozzle is being utilized.

SUMMARY OF THE INVENTION

The present invention provides the art with an improved jet pump nozzle design which incorporates an alignment device which minimizes misalignment between the jet pump nozzle and the throat. In one embodiment, a tapered elliptical slide engages a groove to properly align the jet pump nozzle with the throat prior to ultrasonic welding of the jet pump to the fuel tank. In another embodiment of the present invention, a hook formed on the jet pump nozzle is designed to engage a slot formed on the tank to align the jet pump nozzle with the throat prior to the ultrasonic welding of the two components. In yet another embodiment of the present invention, a tapered peg formed on the tank is designed to engage a slot formed on the jet pump prior of the ultrasonic welding of the two components. In still yet another embodiment of the present invention non-circular ultrasonic welding grooves are formed on the two components. The mating of the two non-circular ultrasonic weld grooves prior to ultrasonic welding of the components ensures the alignment between the jet pump nozzle and the throat.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 1 is a schematic representation of an automotive engine and fuel system which utilizes a unique jet pump in accordance with an embodiment of the present invention;

FIG. 3 is an enlarged cross-sectional view of the jet pump illustrated in FIG. 1;

FIG. 4 is a perspective view of the alignment system for the jet nozzle of the jet pump illustrated in FIGS. 1 and 2;

DETAILED DESCRIPTION OF THE PREFERRED EMBODIMENTS

Figure 2:
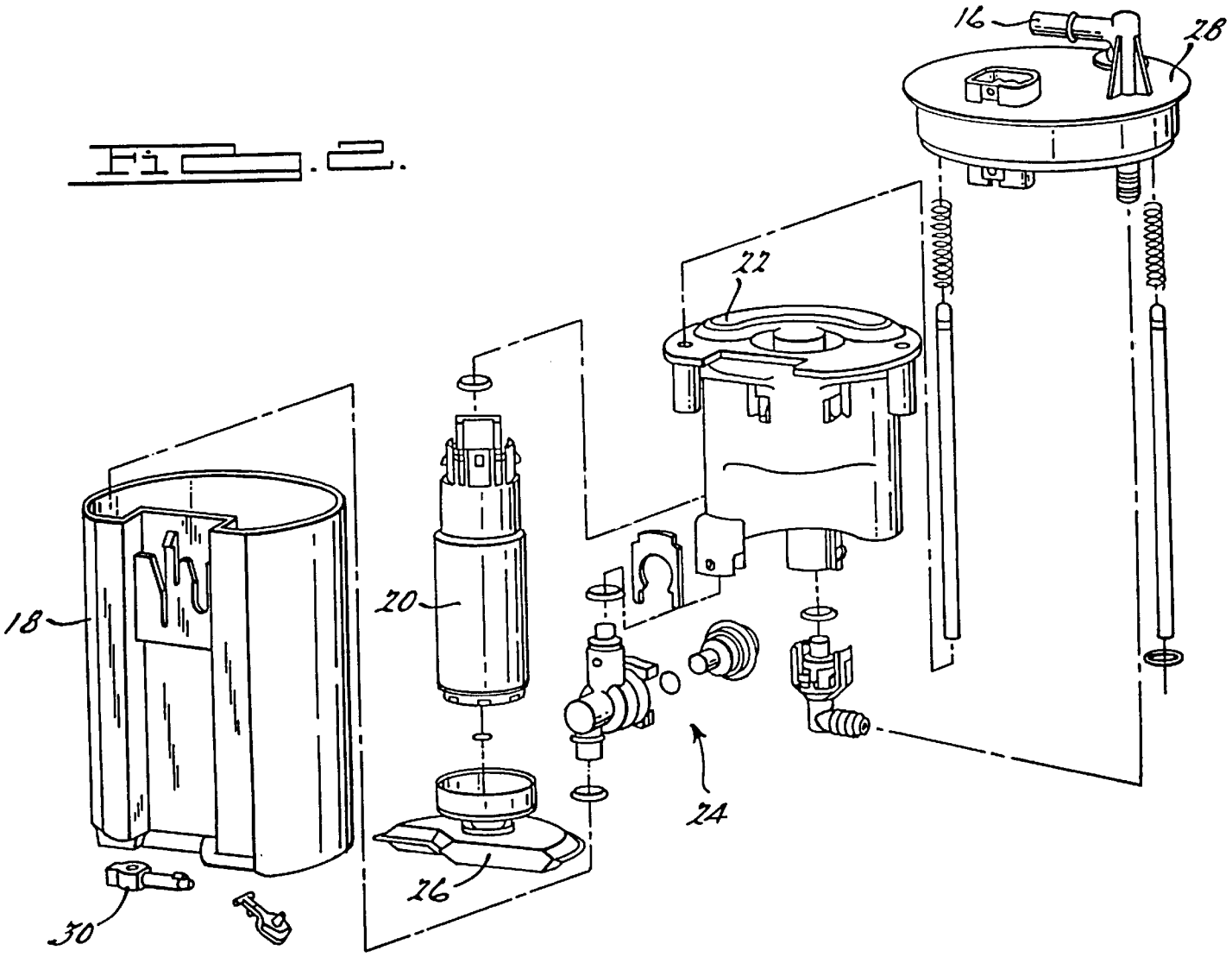
FIG. 2 is an exploded perspective view of the reservoir assembly shown in FIG. 1.

The following description of the preferred embodiment(s) is merely exemplary in nature and is in no way intended to limit the invention, its application, or uses.

Referring now to the drawings in which like reference numerals designate like or corresponding parts throughout the several views, there is shown in FIG. 1 an automotive engine and fuel system which incorporates a unique jet pump in accordance with the present invention and which is designated generally by the reference numeral 10. Automotive engine and fuel system 10 comprises an internal combustion engine 12 of a motor vehicle (not shown) which is supplied with fuel from a fuel tank 14. The fuel is supplied through a feeding conduit 16 which leads from fuel tank 14 to internal combustion engine 12. Feeding conduit 16 provides a continuous supply of high pressure fuel to internal combustion engine 12 and feeding conduit 16 is the only fuel line extending between fuel tank 14 and internal combustion engine 12.

Referring to FIG. 2, a fuel pump module which includes a canister or reservoir 18 is disposed within fuel tank 14. Fuel is pumped from reservoir 18 by a fuel pump 20 through a filter 22 and into feeding conduit 16. In order to maintain a specified pressure of fuel being supplied by fuel pump 20, a pressure regulator assembly 24 is disposed within reservoir 18 and is also in communication with feeding conduit 16. Pressure regulator assembly 24 opens at a specified fluid pressure to return excess fuel back to the reservoir 18 via the jet pump 30. Fuel pump 20 receives fuel through a suction filter 26 and pumps this fuel through filter 22 and into feeding conduit 16. After reservoir 18 is positioned within fuel tank 14, a flange 28 is secured to fuel tank 14 to seal fuel tank 14. A plurality of struts and biasing springs maintain the position of reservoir 18 within fuel tank 14. A jet pump 30 is disposed within fuel tank 14 and it is connected to pressure regulator assembly 24. During the operation of internal combustion engine 12, fuel pump 20 pumps fuel from reservoir 18 in fuel tank 14 through filter 22, through feeding conduit 16 and to internal combustion engine 12. Internal combustion engine 12 utilizes fuel supplied from feeding conduit 16 which is kept at a specified pressure by pressure regulator assembly 24. Excess fuel pumped by fuel pump 20 is returned to reservoir 18 through pressure regulator assembly 24 and jet pump 30. Jet pump 30 is connected to pressure regulator assembly 24 and jet pump 30 pumps fuel from pressure regulator assembly 24 into canister or reservoir 18. Jet pump 30 creates a suction pressure which draws fuel from fuel tank 14 and this fuel along with the excess fuel is pumped into reservoir 18. The pumping of fuel by jet pump 30 from fuel tank 14 into reservoir 18 ensures that reservoir 18 is always sufficiently filled. A check valve maintains the fuel within reservoir 18 when fuel pump 20 is not operating. Jet pump 30 is driven by the fuel which flows through pressure regulator assembly 24 in a manner similar to that known in the art for jet pumps attached to return lines.

Jet pump 30 is illustrated in FIG. 3 partially in cross-section in an enlarged scale. Jet pump 30 comprises a jet nozzle 32, a mixing pipe or throat 34 which is alignment with jet nozzle 32 and a suction opening 36 located between jet nozzle 32 and mixing pipe or throat 34. Jet nozzle 32 is attached to a pump body 38 which is connected at the inlet side to the outlet of pressure regulator assembly 24. Pump body 38 is open to jet nozzle 32 which is in turn opened at its opposite end adjacent mixing pipe or throat 34. Mixing pipe or throat 34 is a formed part of reservoir 18 or mixing pipe or throat 34 is inserted into reservoir 18 near its bottom so that mixing pipe or throat 34 provides a connection between the interior of fuel tank 14 and the interior of canister or reservoir 18.

In the embodiment shown in FIGS. 3 and 4, jet nozzle 32 is arranged a specified distance from the opening of mixing pipe or throat 34 in alignment with throat 34. Suction opening 36 is formed by the free space remaining between jet nozzle 32 and mixing pipe or throat 34. In order to ensure the proper alignment between jet nozzle 32 and throat 34, an alignment mechanism in the form of a tapered elliptical slide 40 (a first alignment device) is formed on the end of the extended barrel of jet nozzle 32. Tapered elliptical slide 40 is designed to engage a slot 42 (a second alignment device) formed by one of the walls of reservoir 18 in fuel tank 14. Once tapered elliptical slide 40 has been inserted into slot 42, pump body 38 of jet pump 30 is ultrasonically welded to reservoir 18 at location 44 on fuel tank 14 and at location 46 on pump body 38 of jet pump 30. One or both of reservoir 18 and pump body 38 of jet pump 30 include formed ultrasonic circular welding grooves 48 to facilitate the ultrasonic welding of pump body 38 of jet pump 30 to reservoir 18.

During the operation of internal combustion engine 12, the fuel which flows through pressure regulator assembly 24 exits as a jet with high speed from jet nozzle 32. The fuel jet receives, in the region of suction opening 36, fuel from within fuel tank 14 and pumps it through mixing pipe or throat 34 along with the jetted fuel so that fuel is fed from fuel tank 14 through mixing pipe or throat 34 opening the check valve and filling the canister or reservoir 18. The fuel that is withdrawn from fuel tank 14 together with the fuel exiting jet nozzle 32 is supplied to the canister or reservoir 18. During the operation of internal combustion engine 12, the constantly operating jet pump 30 guarantees that, independently from the fuel level in fuel tank 14, reservoir 18 is always completely filled with fuel and thereby the fuel to internal combustion engine 12 operates without distortion up to a minimum filling level. The engagement between elliptical slide 40 with slot 42 prior to and during the ultrasonic welding of jet pump 30 to reservoir 18 ensures that jet nozzle 32 will be properly aligned with throat 34 to provide the highest pump efficiency for jet pump 30. During welding, jet pump 30 is inverted. This causes the extended barrel of jet nozzle 32 to tilt or rotate somewhat around circular grooves 48 due to its weight. This tilting could cause misalignment with throat 34. The engagement of tapered elliptical slide 40 with slot 42 prevents the tilting of the extended barrel of jet nozzle 32. As jet pump 30 is welded to reservoir 18, the taper of tapered elliptical slide 40 causes the extended barrel of jet nozzle 32 to center itself during the welding process to further reduce the possibility of misalignment. The elliptical design of tapered elliptical slide 40 enables the operator to slide the extended barrel of jet nozzle 32 into position along the longer axis of the ellipse with ease.

Figure 5:
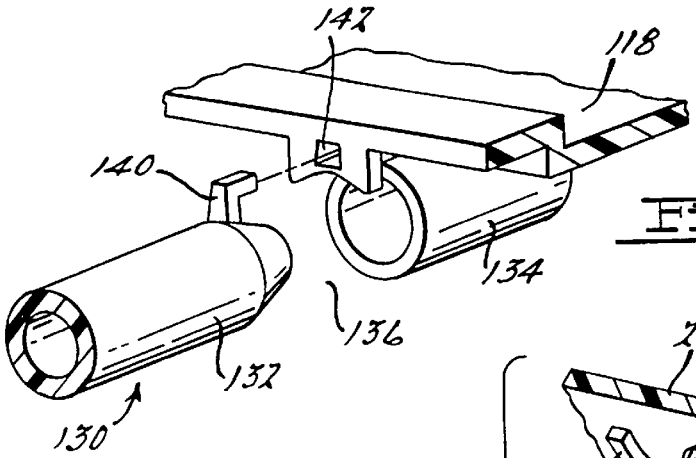
FIG. 5 is a perspective view of an alignment system for the jet nozzle of the jet pump in accordance with another embodiment of the present invention.

Referring now to FIG. 5, a reservoir 118 and a jet pump 130 in accordance with another embodiment of the present invention is illustrated. Jet pump 130 comprises a jet nozzle 132, a mixing pipe or throat 134 which is in alignment with jet nozzle 132 and a suction opening 136 located between jet nozzle 132 and mixing pipe or throat 134. The function and operation of reservoir 118 and jet pump 130 is the same as detailed above for reservoir 18 and jet pump 30. The difference between jet pump 130 and jet pump 30 is in the alignment mechanism. Tapered elliptical slide 40 formed on jet nozzle 32 is replaced by a hook 140 formed on jet nozzle 132 and slot 42 formed on reservoir 18 is replaced by a slot 142 formed on reservoir 118. The engagement between hook 140 and slot 142 ensures the alignment of jet nozzle 132 with throat 134 prior to and during the ultrasonic welding of jet pump 130 to reservoir 118. Jet pump 130 is ultrasonic welded to reservoir 118 at locations 44 and 46 using welding grooves 48 the same as jet pump 30. Hook 140 can easily be inserted into slot 142 by the operator to properly position jet pump 130 prior to the welding process. This will ensure that jet nozzle 132 does not deviate beyond functional limits during the welding process. The hook also includes a taper, thus achieving the self-centering as detailed above.

Figure 6:
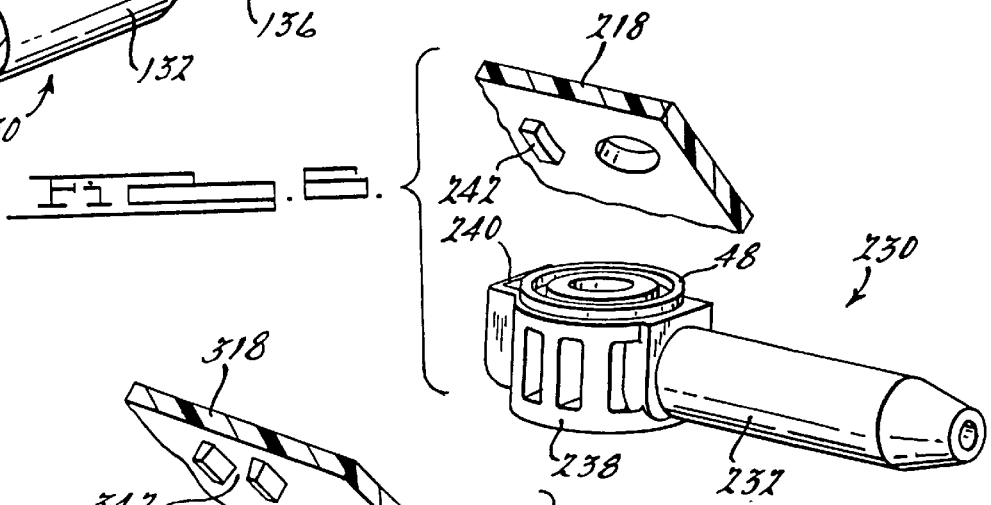
FIG. 6 is a perspective view of an alignment system for the jet nozzle of the jet pump in accordance with another embodiment of the present invention.

Referring now to FIG. 6, a reservoir 218 and a jet pump 230 in accordance with another embodiment of the present invention is illustrated. Jet pump 230 comprises a jet nozzle 232, mixing pipe or throat 134 which is in alignment with jet nozzle 232, suction opening 136 located between jet nozzle 232 and mixing pipe or throat 134 and a pump body 238. The function and operation of reservoir 118 and jet pump 230 is the same as detailed above for reservoir 18 and jet pump 30. The difference between jet pump 230 and jet pump 30 is in the alignment mechanism. Tapered elliptical slide 40 formed on jet nozzle 32 is replaced by a slot 240 formed on pump body 238 and slot 42 formed on reservoir 18 is replaced by a tapered peg 242 formed on reservoir 218. The engagement between tapered peg 242 and slot 240 ensures the alignment of jet nozzle 232 with throat 134 prior to and during the ultrasonic welding of jet pump 230 to reservoir 218. Jet pump 230 is ultrasonically welded to reservoir 218 at locations 44 and 46 using welding grooves 48 the same as jet pump 30. The advantages of this embodiment is tapered peg 242 and slot 240 do not interfere with suction opening 136 of jet pump 230 and that this design can be used irrespective of the length of the extended barrel of jet nozzle 232. In the applications that have a greater demand for suction performance, the area of suction opening 136 becomes a major consideration.

Figure 7:
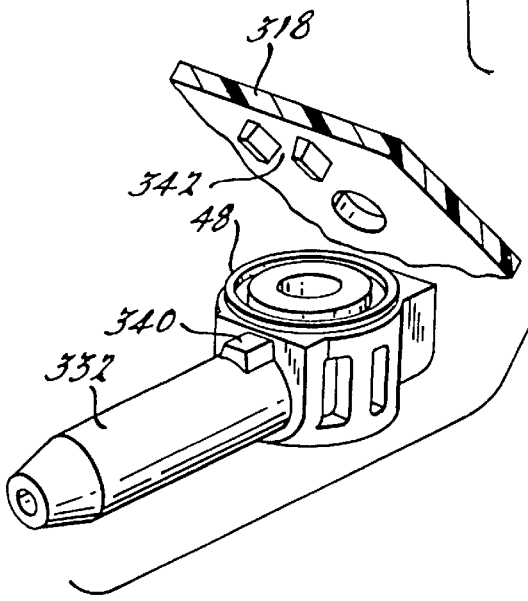
FIG. 7 is a perspective view of an alignment system for the jet nozzle of the jet pump in accordance with another embodiment of the present invention.

Referring now to FIG. 7, a reservoir 318 and a jet pump 330 in accordance with another embodiment of the present invention is illustrated. Jet pump 330 comprises a jet nozzle 332, mixing pipe or throat 134 which is in alignment with jet nozzle 332 and suction opening 136 located between jet nozzle 332 and mixing pipe or throat 134. The function and operation of reservoir 318 and jet pump 330 is the same as detailed above for reservoir 18 and jet pump 30. The difference between jet pump 330 and jet pump 30 is in the alignment mechanism. Tapered elliptical slide 40 formed on jet nozzle 32 is replaced by a tapered elliptical slide 340 formed on jet nozzle 332 and slot 42 formed on fuel tank 14 is replaced by a slot 342 formed on reservoir 318. The engagement between tapered elliptical slide 340 and slot 342 ensures the alignment of jet nozzle 332 with throat 134 prior to and during the ultrasonic welding of jet pump 330 to reservoir 318. Jet pump 330 is ultrasonically welded to reservoir 318 at locations 44 and 46 using welding grooves 48 the same as jet pump 30. This embodiment is similar to the embodiment illustrated in FIG. 4 with the difference being the location of tapered elliptical slide 340 in relation to the location of tapered elliptical slide 40 and the corresponding location of slot 342 in relation to the location of slot 42 which are closer to pump body 38. The advantages of this embodiment is that there is no potential suction flow restriction of suction opening 136.

Figure 8:
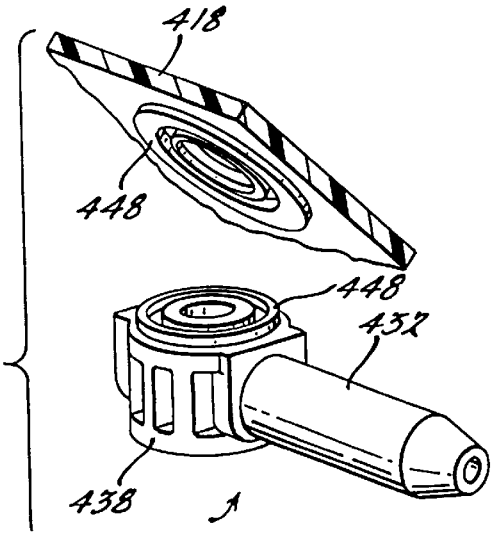
FIG. 8 is a perspective view of an alignment system for the jet nozzle of the jet pump in accordance with another embodiment of the present invention.

Referring now to FIG. 8, a reservoir 418 and a jet pump 430 in accordance with another embodiment of the present invention is illustrated. Jet pump 430 comprises a jet nozzle 432, mixing pipe or throat 134 which is in alignment with jet nozzle 432 and suction opening 136 located between jet nozzle 432 and mixing pipe or throat 134 and a pump body 438. The function and operation of reservoir 418 and jet pump 430 is the same as detailed above for reservoir 18 and jet pump 30. The difference between jet pump 330 and jet pump 30 is in the alignment mechanism. Tapered elliptical slide 40 formed on jet nozzle 32 and slot 42 formed on reservoir 18 have been eliminated. Instead of tapered elliptical slide 40 and slot 42, circular welding grooves 48 on pump body 38 of jet pump 30 are replaced by non-circular welding grooves 448 on reservoir 418 and non-circular grooves 448 on pump body 438 of jet pump 430. Non-circular welding grooves 448 are preferably elliptical in shape in order to avoid any corners that may disrupt a hermetic seal during the ultrasonic welding operation. The mating of the two elliptical designs restricts the amount of rotational deviation possible during the ultrasonic welding operation. Choosing the ratio of the major axis to the minor axis of the ellipse close to unity helps to eliminate the limitations of a circular weld line while retaining the performance of the ultrasonic weld.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel pump module comprising:

a reservoir having an inlet and an outlet;

a fuel pump disposed within said reservoir, said fuel pump being operable to pump fuel from said reservoir through said outlet leading from said reservoir;

a pressure regulator assembly in communication with said outlet for maintaining a specified fluid pressure at said outlet;

a jet pump attached to an outer surface of said reservoir, said jet pump being in fluid communication with said pressure regulator, said jet pump being operable to pump fluid from outside said reservoir through said inlet and into said reservoir, wherein said jet pump further comprises a jet pump body secured to said reservoir;

a jet nozzle extending said jet pump body towards said inlet of said reservoir, such that the jet nozzle spatially apart from said inlet and not encased by the outer surface of said reservoir; and an alignment mechanism attached to said jet pump and said reservoir, said alignment mechanism positioning said jet nozzle with respect to said inlet of said reservoir.

2. The fuel pump module according to claim 1 wherein said alignment mechanism comprises a slide defined by one of said jet nozzle and said reservoir and a slot defined by the other of said jet nozzle and said reservoir, said slide engaging said slot to align said jet nozzle with said inlet of said reservoir.

3. The fuel pump module according to claim 2, wherein said slide and said slot are located at a position distal from said jet pump body.

4. The fuel pump module according to claim 2, wherein said slide and said slot are located at a position adjacent said jet pump body.

5. The fuel pump module according to claim 1 wherein said alignment mechanism comprises a hook defined by one of said jet nozzle and said reservoir and a slot defined by the other of said jet nozzle and said reservoir, said hook engaging said slot to align said jet nozzle with said inlet of said reservoir.

6. The fuel pump module according to claim 1 wherein said alignment mechanism comprises a peg defined by one of said jet pump body and said reservoir and a slot defined by the other of said jet pump body and said reservoir, said peg engaging said slot to align said jet nozzle with said inlet of said reservoir.

7. The fuel pump module according to claim 1 wherein said alignment mechanism comprises a non-circular weld line defined by one of said jet pump body and said reservoir and a non-circular groove defined by the other of said jet pump body and said reservoir, said non-circular weld line engaging said non-circular groove to align said jet nozzle with said inlet of said reservoir.

8. The fuel pump module according to claim 7 wherein said non-circular weld line and said non-circular weld groove are elliptical.

9. A method of attaching a jet pump having a jet pump body and a jet nozzle extending from said jet pump body to a reservoir having an inlet, said method comprising:

providing a first alignment device on said jet pump;

providing a second alignment device on said reservoir;

aligning said jet nozzle with said inlet of said reservoir by engaging said first alignment device with said second alignment device; and securing said jet pump to said reservoir by ultrasonically welding said jet pump to said reservoir.

10. The method according to claim 9 wherein said first alignment device is one of a slide and a slot defined by said jet nozzle, said second alignment device is the other of said slide and said slot defined by said reservoir and said aligning step includes positioning said slide within said slot.

11. The method according to claim 10 wherein said first and second alignment devices are positioned distal from said jet pump body.

12. The method according to claim 10 wherein said first and second alignment devices are positioned adjacent said jet pump body.

13. The method according to claim 9 wherein said first alignment device is one of a hook and a slot defined by said jet nozzle, said second alignment device is the other of said hook and said slot defined by said reservoir and said aligning step includes positioning said hook within said slot.

14. The method according to claim 9 wherein said first alignment device is one of a peg and a slot defined by said jet pump body, said second alignment device is the other of said peg and said slot defined by said reservoir and said aligning step includes positioning said peg within said slot.

15. The method according to claim 9 wherein said first alignment device is one of a non-circular weld line and a non-circular groove defined by said jet pump body, said second alignment device is the other of said non-circular weld line and said non-circular groove defined by said reservoir, and said aligning step includes positioning said non-circular weld line within said non-circular groove.

16. The method according to claim 15 wherein said non-circular weld line and said non-circular groove are elliptical.

17. A fuel pump module comprising:

a jet pump defining a jet pump body, a jet nozzle extending from said jet pump body and a first alignment device;

a reservoir defining a second alignment device; wherein: said jet pump is attached to said reservoir by engaging said first alignment device with said second alignment device and then securing said jet pump body to said reservoir, such that the jet nozzle is spatially apart from an inlet of said reservoir and not encased by an outer surface of said reservoir.

18. The fuel pump module according to claim 17 wherein the securing of said jet pump body to said reservoir comprises ultrasonically welding said jet pump body to said reservoir.

19. The fuel pump module according to claim 17 wherein said first alignment device is one of a slide and a slot defined by said jet nozzle, said second alignment device is the other of said slide and said slot defined by said reservoir and said engaging of said first alignment device with said second alignment device includes positioning said slide within said slot.

20. The fuel pump module according to claim 19 wherein said first and second alignment devices are positioned distal from said jet pump body.

21. The fuel pump module according to claim 19 wherein said first and second alignment devices are positioned adjacent said jet pump body.

22. The fuel pump module according to claim 17 wherein said first alignment device is one of a hook and a slot defined by said jet nozzle, said second alignment device is the other of said hook and said slot defined by said reservoir and said engaging of said first alignment device with said second alignment device includes positioning said hook within said slot.

23. The fuel pump module according to claim 17 wherein said first alignment device is one of a peg and a slot defined by said jet pump body, said second alignment device is the other of said peg and said slot defined by said reservoir and said engaging of said first alignment device with said second alignment device includes positioning said peg within said slot.

24. The fuel pump module according to claim 17 wherein said first alignment device is one of a non-circular weld line and a non-circular groove defined by said jet pump body, said second alignment device is the other of said non-circular weld line and said non-circular groove defined by said reservoir, and said engaging of said first alignment device with said second alignment device includes positioning said non-circular weld line within said non-circular groove.

25. The fuel pump module according to claim 24 wherein said non-circular weld line and said non-circular groove are elliptical.

26. The fuel pump module of claim 1 wherein an inlet of the jet pump is directly in fluid communication with an internal chamber of said reservoir via an opening in the outer surface of said reservoir.

* * * * *